US005371575A

United States Patent [19]

Sekino et al.

[11] Patent Number: 5,371,575

[45] Date of Patent: Dec. 6, 1994

[54] ELECTROPHOTOGRAPHIC IMAGE FORMING APPARATUS WITH DETACHABLE IMAGING CARTRIDGE

[75] Inventors: Hitoshi Sekino, Chigasaki; Satoshi Yoshida, Isehara; Narutaka Yoshida; Takashi Akazawa, both of Machida, all of Japan

[73] Assignee: Minolta Camera Kabushiki Kaisha, Osaka, Japan

[21] Appl. No.: 922,755

[22] Filed: Jul. 30, 1992

[30] Foreign Application Priority Data

| | | | |
|---|---|---|---|
| Aug. 2, 1991 | [JP] | Japan | 3-194333 |
| Aug. 16, 1991 | [JP] | Japan | 3-205843 |
| Aug. 16, 1991 | [JP] | Japan | 3-205844 |
| Sep. 11, 1991 | [JP] | Japan | 3-259736 |

[51] Int. Cl.[5] ..... G03G 13/00

[52] U.S. Cl. ..... 355/210; 355/271; 355/277

[58] Field of Search ..... 355/200, 208, 210, 211, 355/271, 274, 277, 279

[56] References Cited

U.S. PATENT DOCUMENTS

| | | | |
|---|---|---|---|
| 3,985,436 | 10/1976 | Tanaka et al. | 355/200 |
| 4,413,049 | 11/1983 | Beaudet et al. | 430/126 |
| 4,641,948 | 2/1987 | Nakahata et al. | 355/224 |
| 4,766,455 | 8/1988 | Carter | 355/212 |
| 4,786,938 | 11/1988 | Carter | 355/271 |
| 4,806,967 | 2/1989 | Newbury | 355/210 |
| 4,827,308 | 5/1989 | Howard et al. | 355/271 |
| 4,831,407 | 5/1989 | Howard et al. | 355/219 X |
| 4,835,568 | 5/1989 | Howard et al. | 355/219 |
| 4,924,267 | 5/1990 | Yoshikawa et al. | 355/210 |
| 4,994,861 | 2/1991 | Brandon et al. | 355/274 |
| 5,008,711 | 4/1991 | Sakamoto et al. | 355/206 |
| 5,012,293 | 4/1991 | Aldrich et al. | 355/274 |
| 5,029,316 | 7/1991 | Koiso | 355/299 |
| 5,070,370 | 12/1991 | Bellis | 355/271 |
| 5,083,170 | 1/1992 | Sawada et al. | 355/319 |
| 5,103,261 | 4/1992 | Matsuo et al. | 355/210 |
| 5,122,839 | 6/1992 | Siegel et al. | 355/299 |
| 5,130,752 | 7/1992 | Morishita et al. | 355/274 |
| 5,138,372 | 8/1992 | Delecca | 355/200 |

FOREIGN PATENT DOCUMENTS

| | | |
|---|---|---|
| 240337 | 10/1987 | European Pat. Off. . |
| 437097 | 7/1991 | European Pat. Off. . |
| 63-4562 | of 1983 | Japan . |
| 60-140264 | 7/1985 | Japan . |
| 2-166487 | of 1990 | Japan . |
| 2199537 | 7/1988 | United Kingdom . |

*Primary Examiner*—Leo P. Picard
*Assistant Examiner*—Christopher Horgan
*Attorney, Agent, or Firm*—Willian Brinks Hofer Gilson & Lione

[57] ABSTRACT

The present invention provides an image forming apparatus comprising a main assembly and an imaging cartridge detachable from the main assembly. The imaging cartridge includes a first unit and a second unit, both of which are separable form each other, a toner image carrier provided in the first unit, and a charging device provided in the second unit for transferring a toner image on the toner image carrier onto a copy sheet, wherein the charging device includes a charging roller. The present invention also provides an imaging cartridge detachable from the main assembly of an image forming apparatus. The imaging cartridge comprises a first unit and a second unit wherein the second unit is separable from the first unit, a toner image carrier provided in the first unit, and a charging device provided in the second unit for transferring a toner image on the toner image carrier onto a copy sheet.

42 Claims, 15 Drawing Sheets

ELECTROPHOTOGRAPHIC IMAGE FORMING APPARATUS WITH DETACHABLE IMAGING CARTRIDGE

BACKGROUND OF THE INVENTION (1) Field of the Invention

The present invention relates to an image forming apparatus such as a copying machine and a printer used in an electrophotographic method, and particularly, to an image forming apparatus with a detachable imaging cartridge.

(2) Description of the Related Art

An image forming apparatus with a detachable imaging cartridge enclosing a photosensitive material, an electrostatic charging device, a developing device, and a cleaner is described for example in U.S. Pat. No. 3,985,436. Such a detachable imaging cartridge facilitates replacement of these parts when they are deteriorated with use, and development in a different color. With such a construction, however, the photosensitive material is susceptible to light exposure at the removal of the imaging cartridge when it does not enclose a charging device for transferring a toner image on the photosensitive material onto a copy sheet, which results in damage to and deterioration of the photosensitive material.

U.S. Pat. No. 4,831,407 therefore discloses an imaging cartridge enclosing the charging device so that it protects the photosensitive material from light exposure. In addition, the charging device hingedly mounted to the imaging cartridge enables easy clearance of jammed copy sheets. However, inconvenience in handling due to its protrusive form makes it unfavorable to practical use. Moreover, the charging device is not separable from the imaging cartridge.

Japanese Laid-open Utility Model No. 63-4562 discloses an imaging cartridge enclosing a charging roller. The charging roller is designed so that it contacts to the photosensitive material only when the image transfer occurs. However, neither separability of the charging roller from the imaging cartridge nor a cleaner for the charging roller is disclosed therein.

SUMMARY OF THE INVENTION

The present invention has a primary object to provide a detachable imaging cartridge with handling facility, and an image forming apparatus for an electrophotographic method using such an imaging cartridge, more precisely, to provide an imaging cartridge such that protects a toner image carrier from light exposure, and from damage at jammed copy sheets clearance between the toner image carrier and charging device.

The above object is fulfilled by a housing enclosing a first unit and a second unit, wherein the first unit includes the toner image carrier while the second unit includes the charging device, and the first and second units are separable from each other.

Constructed as above, replacing the first unit together with the second unit makes it possible to protect the toner image carrier from light exposure, and enables handling facility as well. In addition, a space provided between the first and second units contributes to prevention of the damage to the toner image carrier by removing the friction of the jammed copy sheet against it. Furthermore, the first and second units are replaceable separately.

The present invention has another object to provide a detachable imaging cartridge with handling facility, and an image forming apparatus for an electrophotographic method using such an imaging cartridge, more precisely, to provide an imaging cartridge such that prevents contamination on the back of a copy sheet as well as damage to the toner image carrier due to residual toner particles on a charging roller used as a charging device.

The above object is fulfilled by installing a cleaning device for the charging roller in the imaging cartridge. The cleaning device may comprise a resilient blade placed so as to press-contact to the charging roller.

The present invention has yet another object to provide a detachable imaging cartridge with handling facility, and an image forming apparatus for an electrophotographic method using such an imaging cartridge, more precisely, to provide a cartridge such that removes static-electricity on a copy sheet after the image transfer in order to prevent the contact between the copy sheet and the housing, which causes deterioration of the image.

The above object is fulfilled by installing an eraser in the vicinity of the charging device in order to erase static-electricity remaining on the copy sheet. Such an eraser may comprise a brush or a plate with a number of tapering tips.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawing:

FIG. 5(*b*) is a side elevation of the imaging cartridge;

FIG. 6(*b*) is a side elevation of the imaging cartridge of which the photosensitive block and transfer block are connected together;

FIG. 8(*b*) is a side elevation of the imaging cartridge of which the photosensitive block and transfer block are separated from each other;

DESCRIPTION OF THE PREFERRED EMBODIMENTS

Embodiment I

Figure 1:
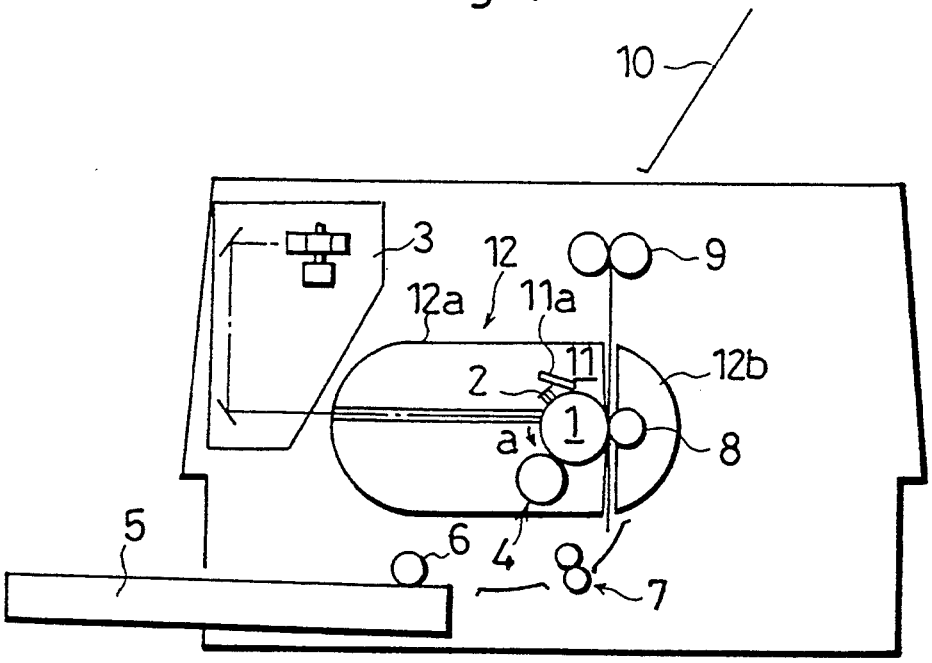
FIG. 1 is a cross sectional view of an imaging forming apparatus.
Figure 2:
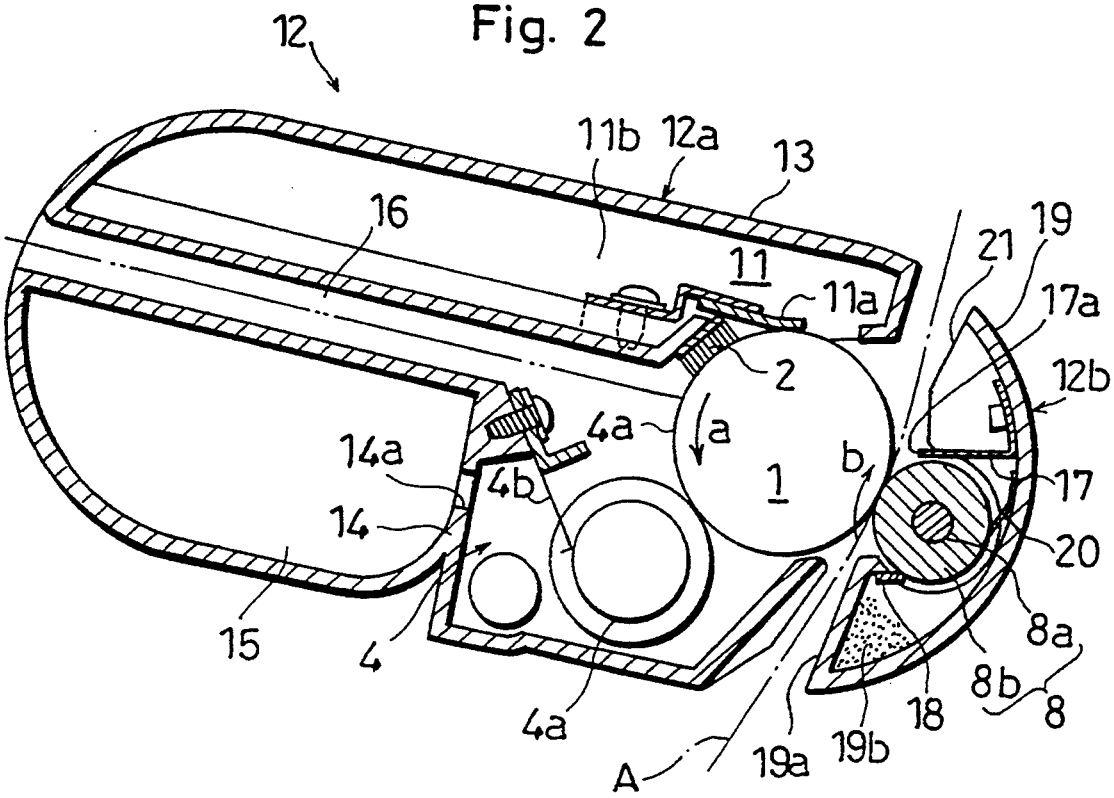
FIG. 2 is a cross sectional view of an imaging cartridge of FIG. 1.

A laser beam printer with a detachable imaging cartridge is shown in FIG. 1. As is shown in FIG. 2, a detachable imaging cartridge 12 comprises a photosensitive block 12*a* and a transferring block 12*b*, which are separable from each other at a path A for a copy sheet. The photosensitive block 12*a* comprises a housing 13 enclosing a photosensitive drum 1, an electro-static charging brush 2, a developing device 4, and a cleaner 11, while the transferring block 12*b* comprises a housing 19 enclosing a charging roller 8, an erasing plate 17, and a blade 18 for cleaning the charging roller 8.

The photosensitive drum 1 turns counterclockwise as indicated by an arrow a, on which the electro-static charging brush 2 charges a given voltage, and subsequently a print head 3 irradiates a laser beam corresponding to an image signal through a space 16 between the developing device 4 and cleaner 11 to form an electro-static latent image.

At the developing device 4, in order to develop the electro-static latent image into a toner image, a toner tank 15, consisting of a resin wall 14, or a part of the housing 13, supplies toner through an opening 14*a* using a shuttle (not shown) to the developing sleeve 4*a* so that toner forms a layer at the periphery thereof, while a doctor 4*b* controls the thickness thereof. After the development, the cleaner 11, placed at the end rotation of the photosensitive drum 1, scrapes residual toner particles on the surface thereof with a blade 11*a*, and collects them into a used toner tank 11*b* formed in the housing 13.

In the meantime, a feeding roller 6, a forwarding roller 7, and a feeding guide 19*a* formed at the upper stream of the path A feed a copy sheet in a tray 5 to a nip between the photosensitive drum 1 and charging roller 8. Further, a number of protrusive ribs 21 formed perpendicular to the internal of the housing 19 guide the copy sheet to a thermal fixing device 9 consisting of a pair of rollers.

Figure 3:
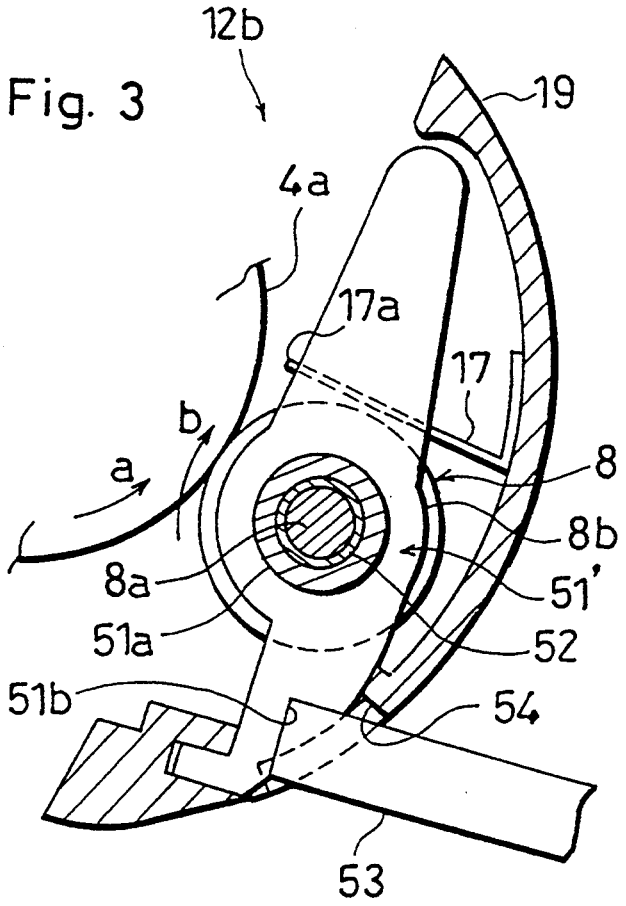
FIG. 3 is an extended cross sectional view of the charging device.
Figure 4:
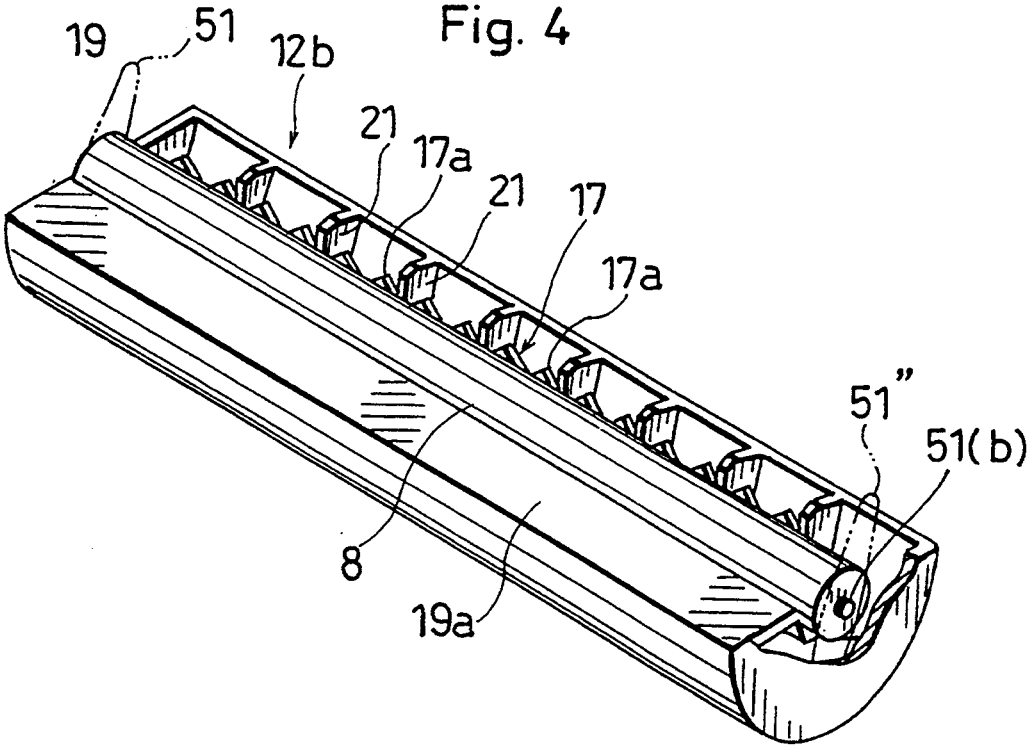
FIG. 4 is a perspective view of a main part of the imaging cartridge.

The charging roller 8 comprises a conductive supporting axis 8*a* encircled with a conductive rubber 8*b*, and press-contacts to the photosensitive drum 1 so as to rotate in the direction of an arrow b in relation with the rotation thereof. A bearing unit 51" shown in FIG. 4 contacts to an electrode(not shown) in the housing 19, hence, it applies a given bias voltage to the charging roller 8 through the supporting axis 8*a*, making it possible to transfer the toner image onto the copy sheet. On the other hand, as shown in FIG. 3, a bearings unit 51' made from conductive metal supports a supporting axis 8*a* to rotate in a boss 51*a* through an insulating ring 52, and connects electrically the erasing plate 17 and an earth terminal 53 extended from the main assembly to a notch 51*b* through a window 54 of the housing 19. As shown in FIG. 3, the erasing plate 17 made from a conductive metal plate is adhered to the internal of the housing 19 at one end while a number of tapering tips 17*a* opposing to the copy sheet are formed at the other end. With these tapering tips 17*a*, the copy sheet is removed of static-electricity, and forwarded to a catch tray 10 attached on the out surface of the image forming apparatus.

Upon the image transfer, the blade 18, cantilevered to the housing 19 and press-contacted to the charging roller 8, cleans the surface thereof by scraping residual toner particles, which are collected into a used toner tank 19*b*. In addition, a Mylar sheet 20 is adhered to the housing 19 at one end and contacted to the charging roller 8 at the other end, thus, preventing the scraped toner particles from scattering onto the other devices.

Figure 5A:
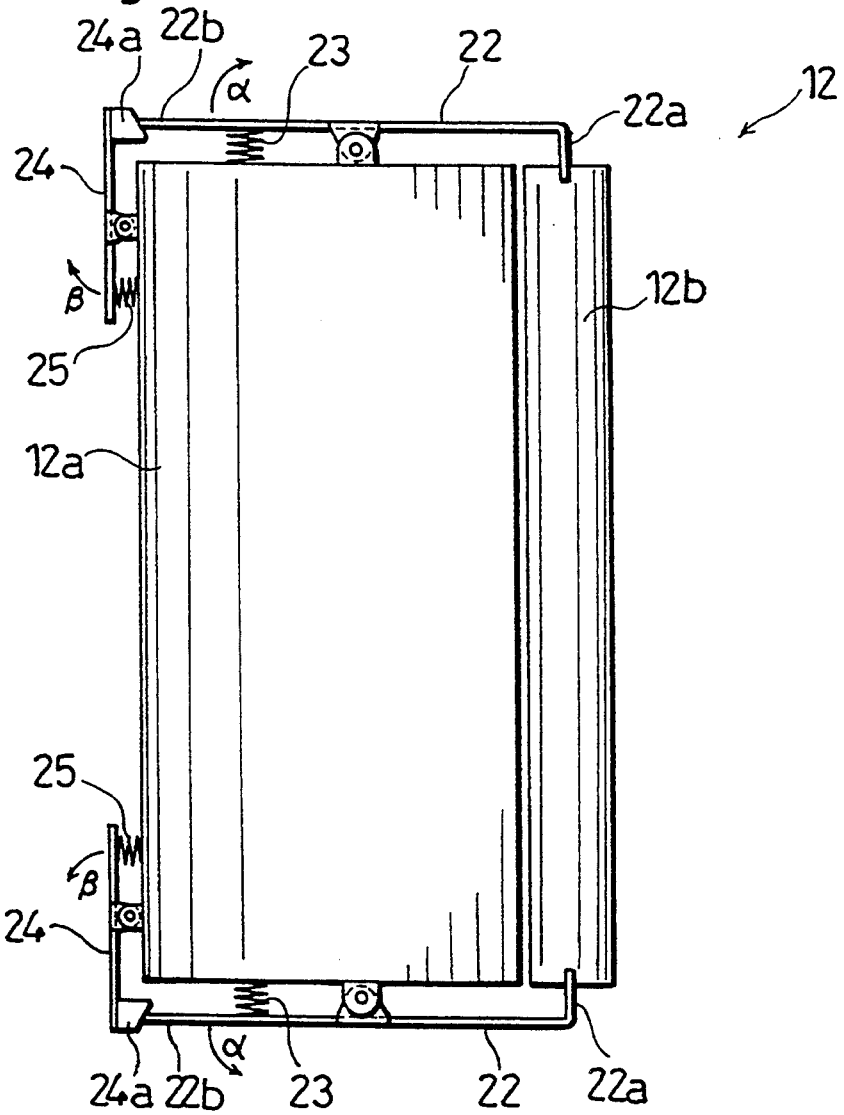
FIG. 5(*a*) is a top view of the imaging cartridge.
Figure 5B:
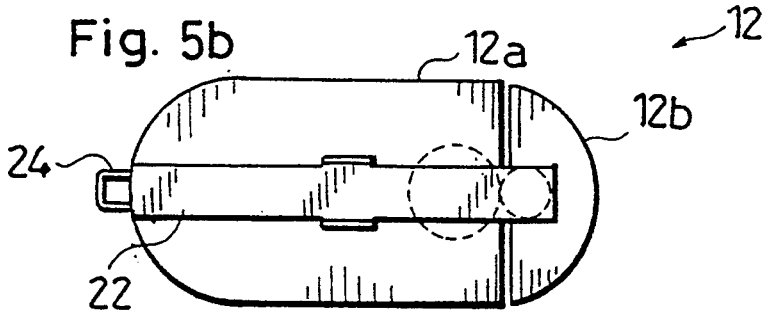

A structure such that enables separation from/connection with the photosensitive block 12*a* and transferring block 12*b* is described with referring to FIGS. 5(*a*) and (*b*).

In FIGS. 5(*a*) and (*b*), two first lock plates 22 are pivotally connected to the photosensitive block 12*a* at the ends thereof, respectively. Each first lock plate 22 is bent toward the photosensitive block 12*a* at one end, denoted as the ends 22*a*, so that when the first lock plates 22 are urged in the direction of an arrow $\alpha$ by compressed springs 23, they engage in the grooves of the transferring block 12*b*, connecting the photosensitive block 12*a* and transferring block 12*b* together. As well two second lock plates 24 are pivotally connected the photosensitive block 12*a* at one side thereof. Each second lock plate 24 is bent toward the first lock plates 22 in order to form a tapered end, which is denoted as end 24*a*. Hence, when the second lock plates 24 are urged in the direction of $\beta$ by compressed springs 25, they press-contact to the other ends of the first lock plate 22, denoted as the ends 22*b*.

It is a separating/connecting device that separates from/connect together the photosensitive block 12*a* and transferring block 12*b*.

Figure 6A:
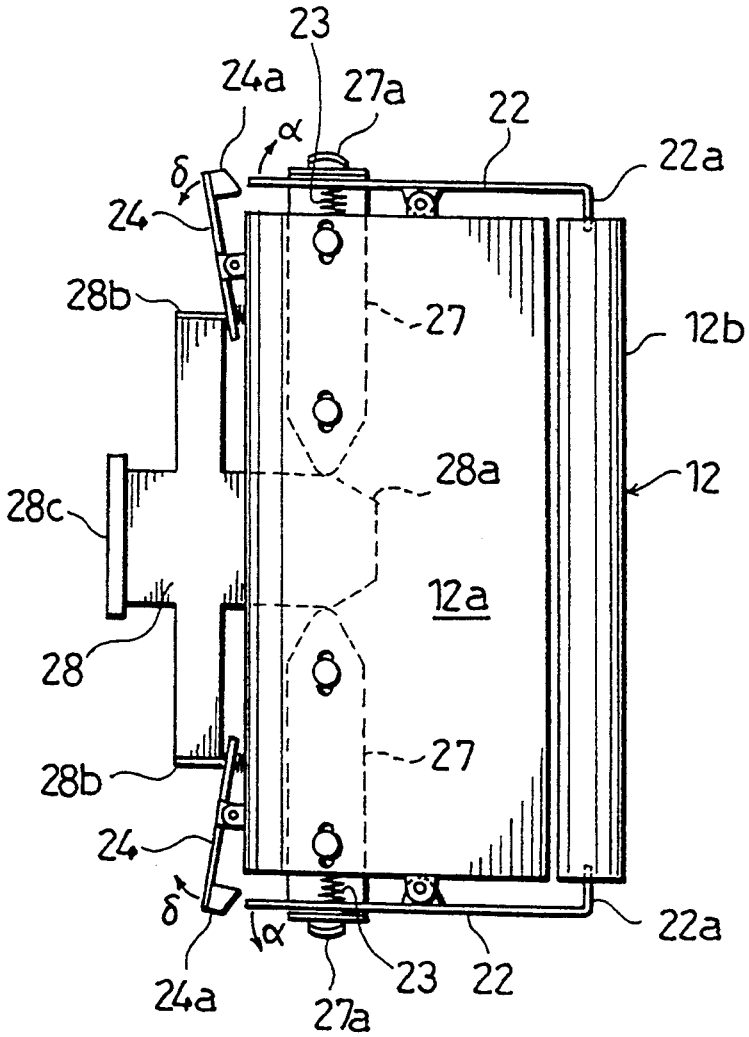
FIG. 6(*a*) is a top view of the imaging cartridge of which the photosensitive block and transfer block are connected together.
Figure 6B:
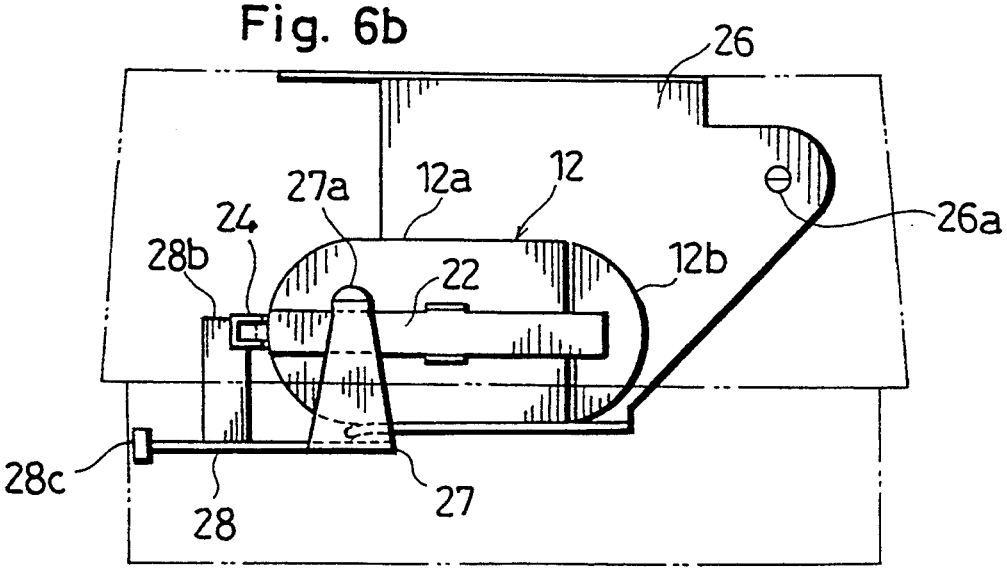

As shown in FIGS. 6(*a*) and 6(*b*), the separating/connecting device comprises two slidable restricting plates 27 placed at the bottom of the housing 13 with the imaging cartridge 12 therebetween, and a lock releasing plate 28. The restricting plates 27 are designed so that they approach each other with an urge from springs(not shown). Each restricting plate 27 is bent upward at one end, denoted as the ends 27*a*, so as to press-contact to the first lock plates 22. The lock releasing plate 28 has a cross form if seen from the top, and is slidable in the direction orthogonal to that of the restricting plates 27. One end of the lock releasing plate 28, denoted as the end 28*a*, is placed between the restricting plates 27, so that it forces the restricting plates 27 to move apart. Two ends of the lock releasing plate 28, denoted as the ends 28*b* are bent upward so as to press-contact to the second lock plate 24. The end of the releasing plate 28, denoted as the end 28*c*, forms a knob, with which an operator separates/connects the photosensitive block 12*a* from/and transferring block 12*b*.

As shown in FIG. 6(*a*), when the lock releasing plate 28 is pushed forward, the ends 28*b* moves the second lock plates 24 in the direction of $\beta$, thereby releasing the lock of the first lock plates 22. Then, the springs 23 urge the first lock plates 22 in the direction of $\alpha$, so that the ends 22*a* engage in the grooves of the transferring block 12*b*.

Figure 7:
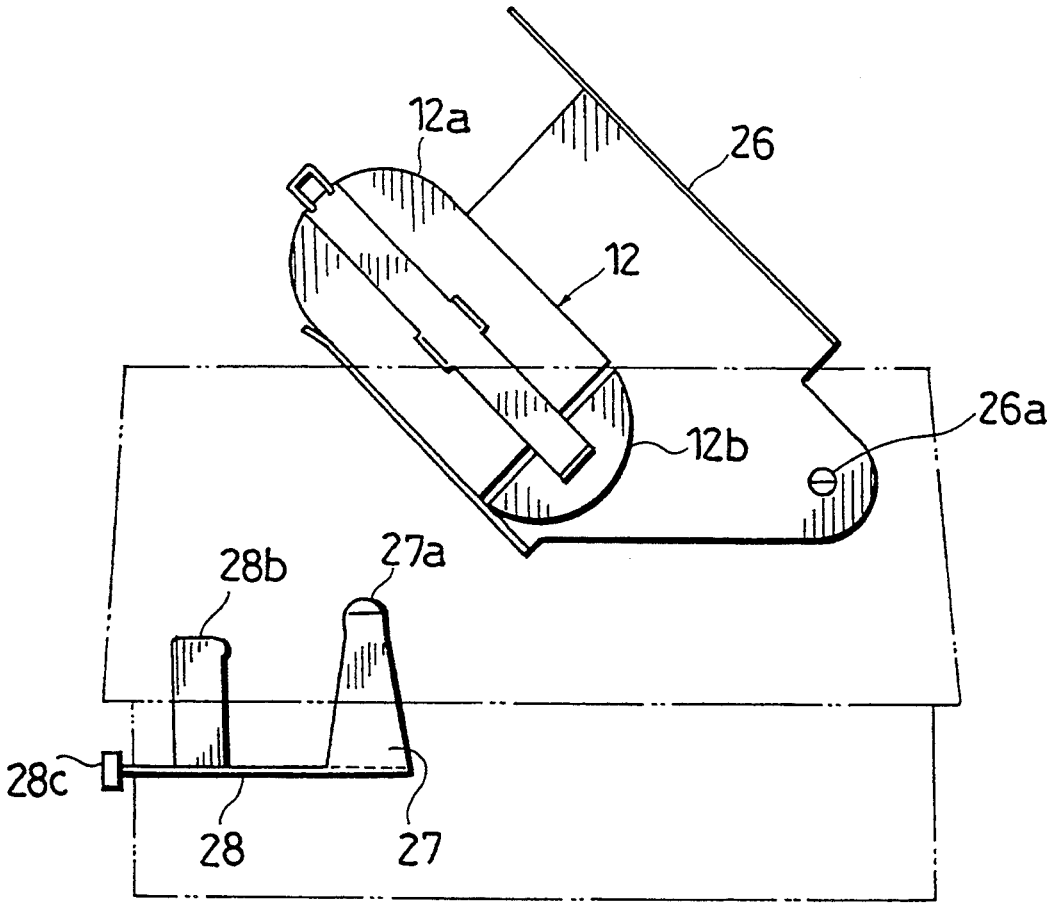
FIG. 7 is a view showing the imaging cartridge being removed from the image forming apparatus when the photosensitive block and transfer block are connected together.

Thus, as shown in FIG. 7, the photosensitive block 12*a* and transferring block 12*b* on a supporting frame 26, which is pivotal about a supporting point 26*b*, are removed from the main assembly by lifting the support frame 26 upward as well as to set these blocks to a predetermined position by pushing the supporting frame 26 downward to a given position.

Figure 8A:
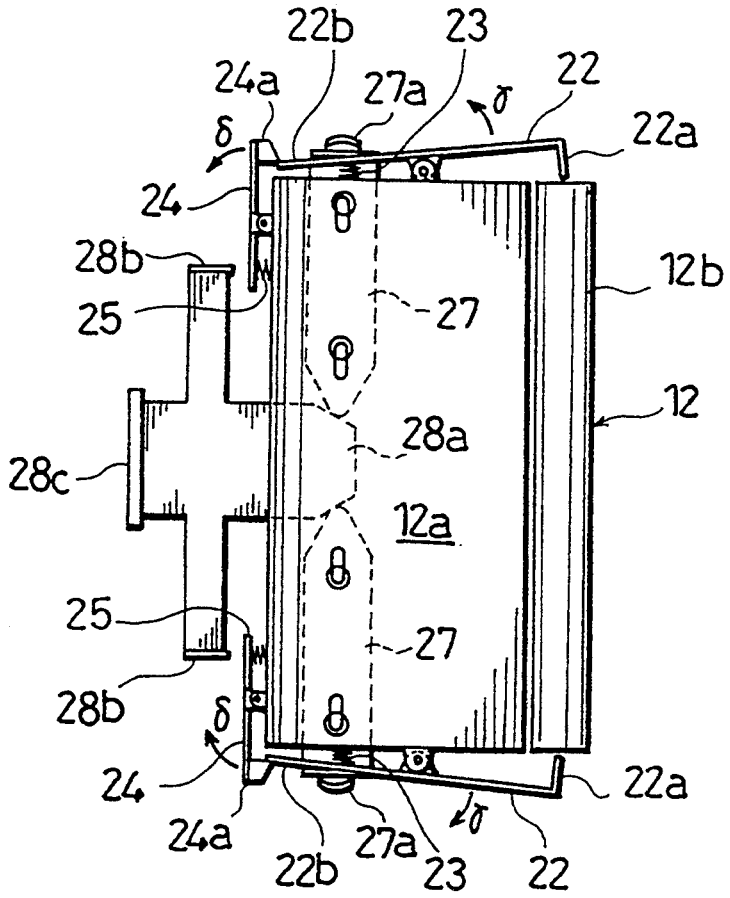
FIG. 8(*a*) is a view showing an example of the cartridge of which the photosensitive block and transfer block are separated from each other.
Figure 8B:
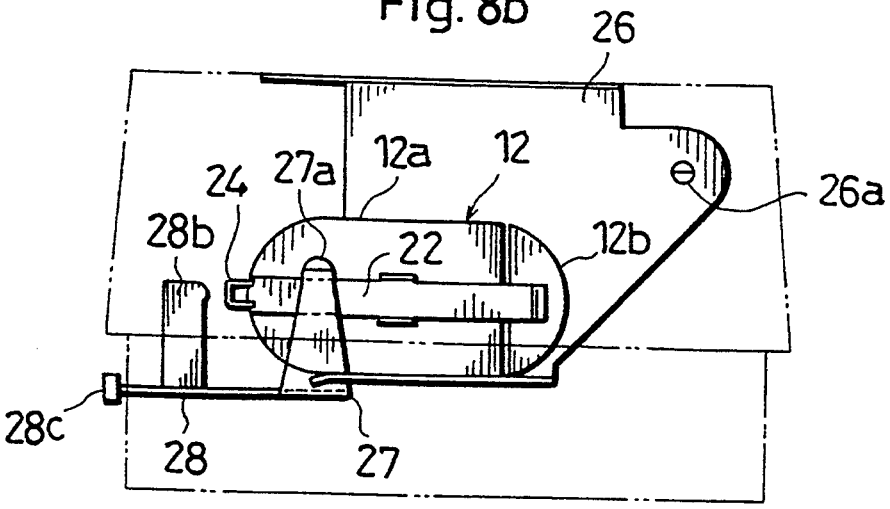
Figure 9:
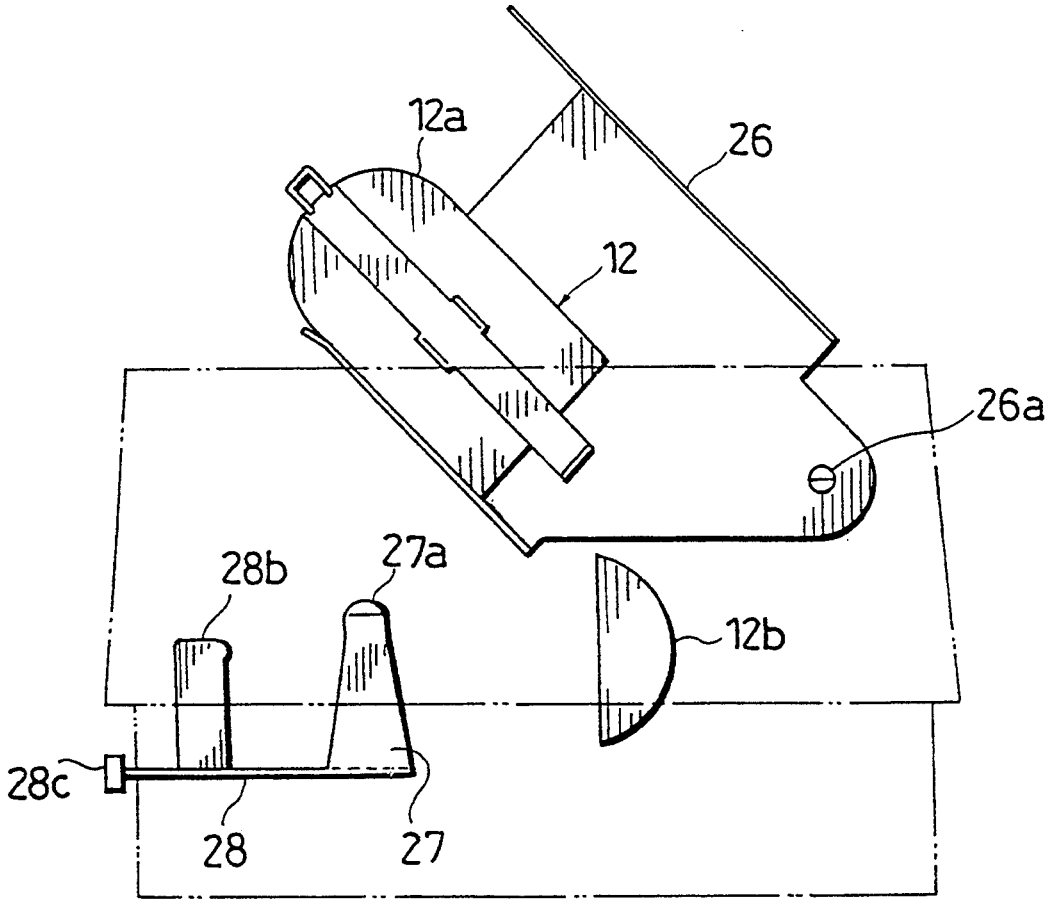
FIG. 9 is a view showing the imaging cartridge being removed from the image forming apparatus when the photosensitive block and transfer block are separated from each other.

As shown in FIGS. 8(*a*) and 8(*b*), when the lock releasing plate 28 is pulled backward, the ends 27*a* push the ends 22*b*, and moves the first lock plates 22 in the direction of $\gamma$, thereby releasing the engagement between the ends 22*a* and the transferring block 12*b*. In turn, the ends 22*b* push the ends 24*a*, and moves the second lock plates 24 in the direction of $\delta$. When the ends 22*b* are pushed the second lock plates 24 inward over the ends 24*a*, the springs 25 urge the second locking plate 24 back to the starting position, thereby locking the first lock plates 22. Thus, as shown in FIG. 9, lifting the supporting frame 26 upward makes it possible to remove only the photosensitive block 12*a* while leaving the transferring block 12*b* inside.

The imaging cartridge 12 is easily replaced with another when deteriorated with use. Capacities of the toner tank 15 and used toner tanks 11*b* and 19*b* may be determined based on the life of the photosensitive drum 1.

The developing device 4 and/or toner tank 15 are not necessarily enclosed in the imaging cartridge 12, and the erasing device may be a brush instead of the tapering tips, or it may contact to the copy sheet as long as it is made of a elastic material.

Embodiment II

Figure 10A:
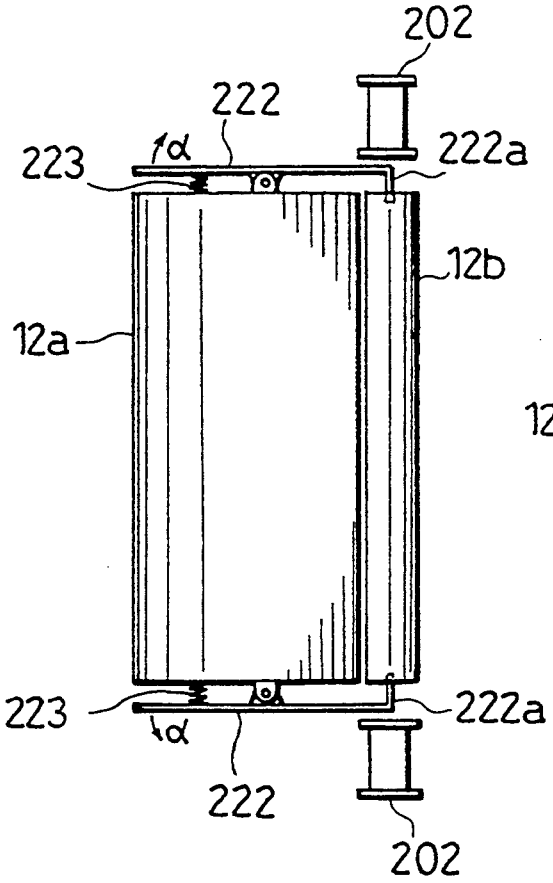
FIG. 10(*a*) and (*b*) are top views of the imaging cartridge with solenoids in Embodiment II.
Figure 10B:
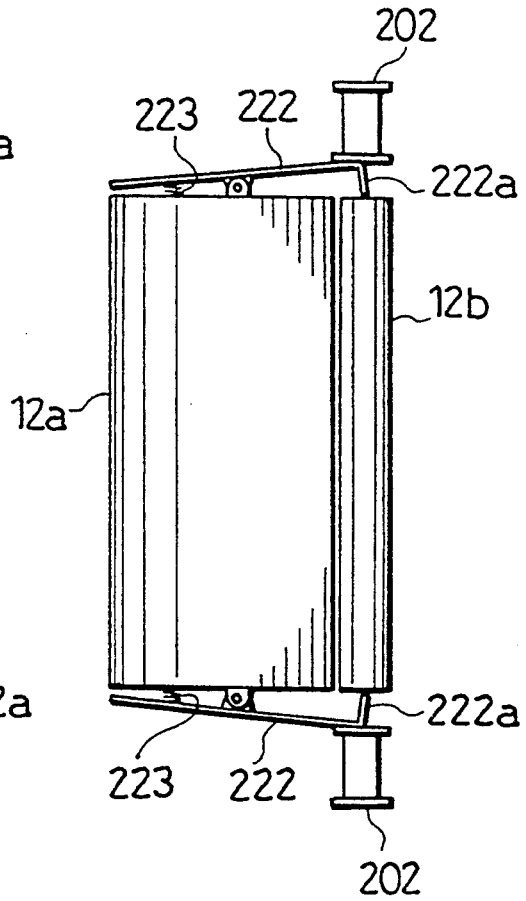
Figure 11:
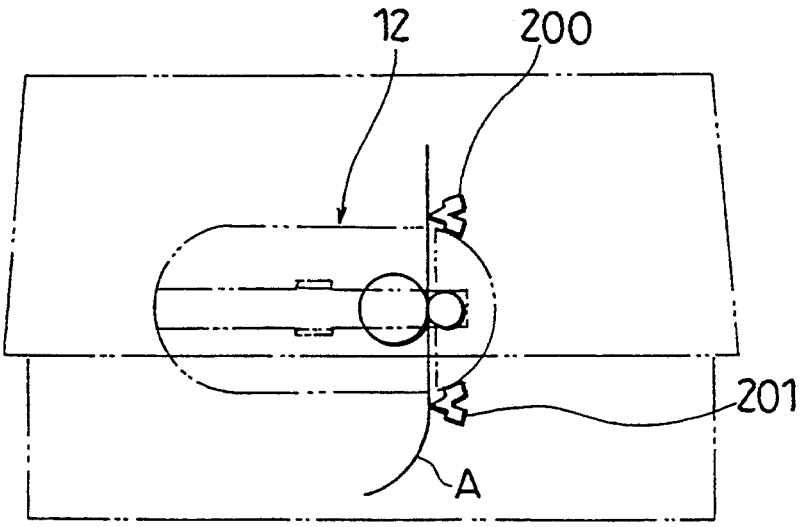
FIG. 11 is a cross sectional view showing paper sensors 100 and 101 in their operation position.

In Embodiment II, an automatic separating/connecting device installed in the printer is described with referring to FIGS. 10(*a*)–12.

As shown in FIGS. 10(*a*) and 10(*b*), solenoids 202, opposing to the ends of lock plates 222, denoted as the ends 222*a*, operate under the control of paper sensors 200 and 201 which are installed at the upper and lower stream of the path A, respectively, in order to detect the presence of a copy sheet therein.

More precisely, when the paper sensors 200 and 201 do not detect a copy sheet, a voltage is not applied to the solenoids 202, hence, compressed springs 223 urge the lock plates 222 in the direction of $\alpha$, so that the ends 222*a* engage in the grooves of the transferring block 12*b*. Whereas when the paper sensors 200 and 201 detect a copy sheet, a voltage is applied to the solenoids 202, hence, the ends 222*a* are attracted thereto, so that the engagement between the ends 222*a* and the groove of the transferring block are released.

Figure 12:
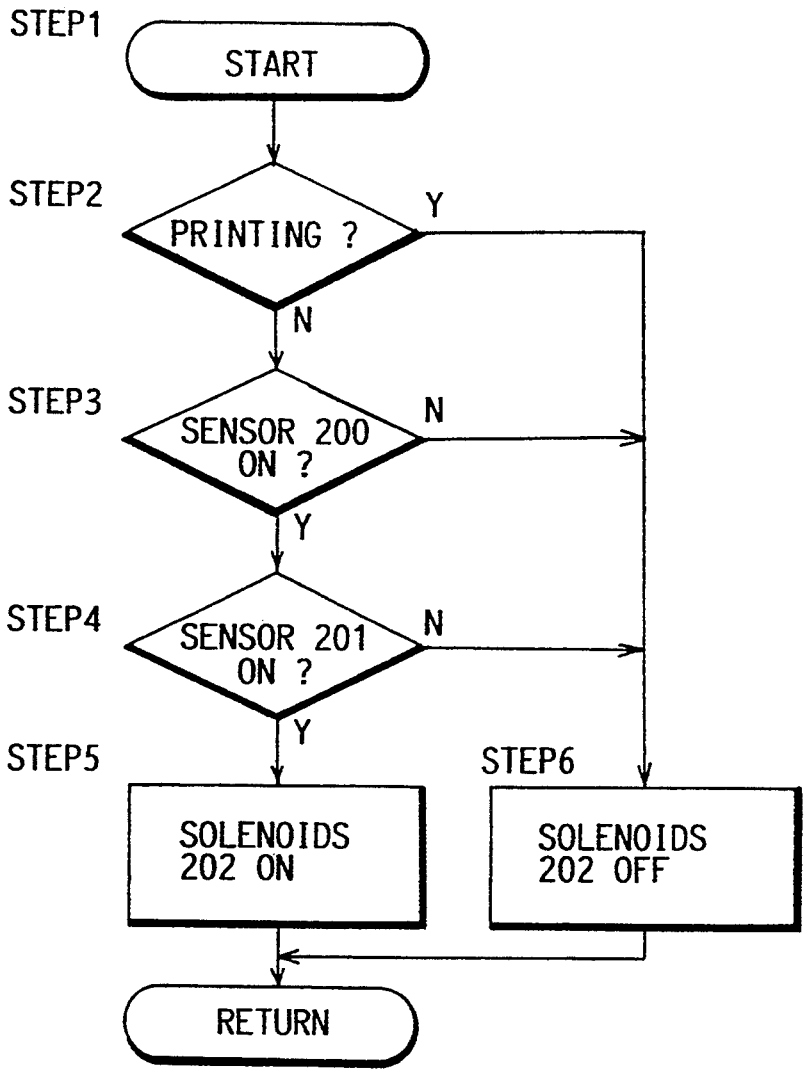
FIG. 12 is a flowchart for a control on separating-/connecting routine.

Such a separation/connecting procedure is summarized in a flowchart in FIG. 12.

STEP 1—Start a separation/connecting control routine, which is a sub-routine in the image forming apparatus.

STEP 2—Detect printing operation. If yes, skip to STEP 6 and if no, go to STEP 3.

STEP 3—Detect the copy sheet in the path A by the paper sensor 200. If yes, go to STEP 4, if no, skip to STEP 6.

STEP 4—Detect the copy sheet in the path A by the paper sensor 201. If yes, go to STEP 5, if no, skip to STEP 6.

STEP 5—Separating the photosensitive block 12*a* from the transferring block 12*b* by operating the solenoids 202.

STEP 6—Halting the operation of the solenoids 202 and maintains the connecting between the photosensitive block 12*a* and transferring block 12*b*.

The solenoids 202 may be designed to operate based on the detection from one of the paper sensor 200 or 201, and a detection device for jammed copy sheets may be installed so that the photosensitive block 12*a* is separated from the transferring block 12*b* when a jam occurs in any place inside the main assembly. A device may be installed such that judges the deterioration of the photosensitive block 12*a* and transferring block 12*b* by counting times of the replacement of the former, and that of the image forming, respectively. Further, the device connects the photosensitive block 12*a* and transferring block 12*b* when both of them need to be replaced, and separates the former from the latter when only one of them needs to be replaced.

Embodiment III

Described in FIGS. 13–16 is a laser beam printer with a detachable imaging cartridge with facility in clearance of jammed copy sheets between the photosensitive drum and charging roller.

Figure 13:
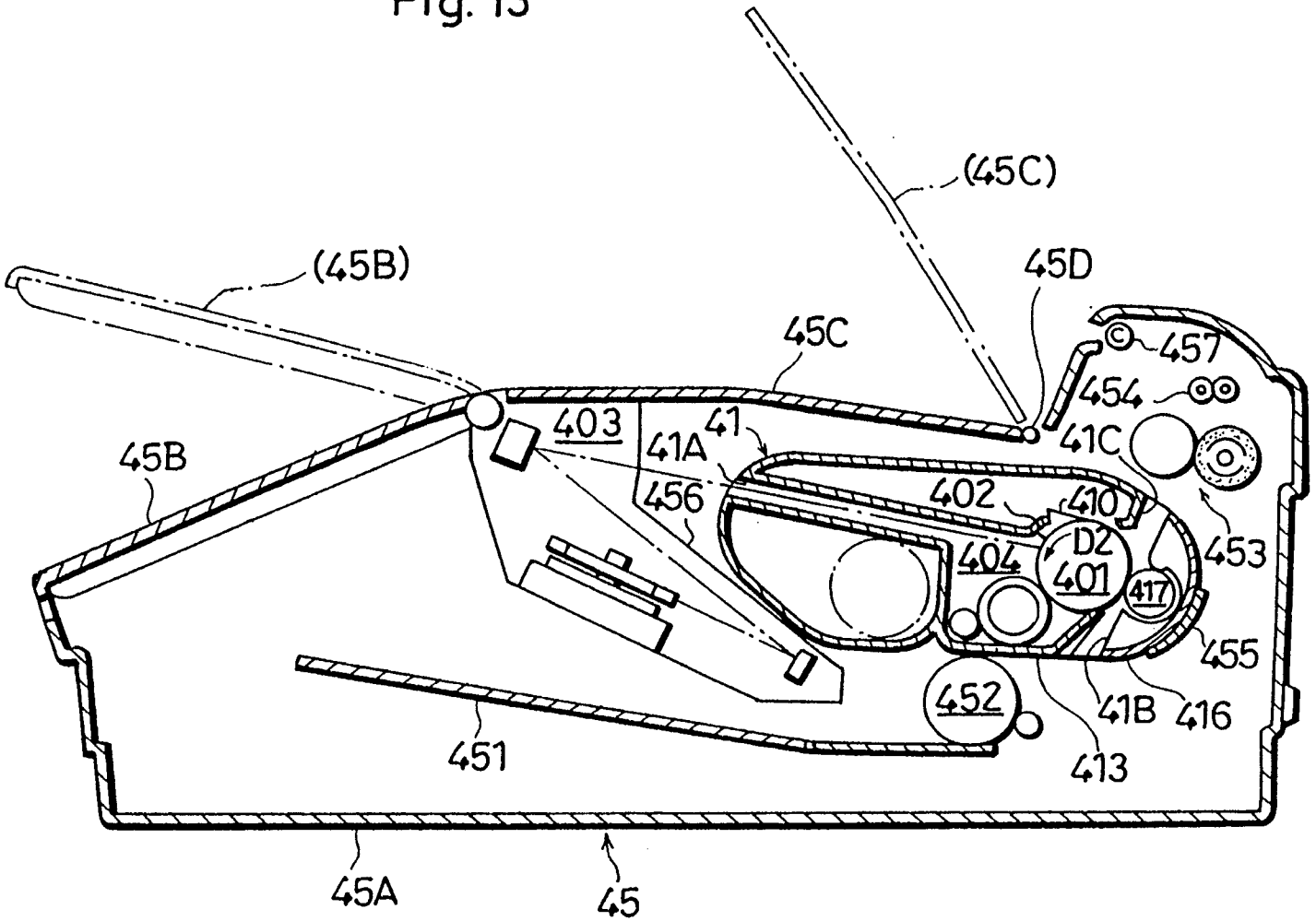
FIG. 13 is a cross sectional view of a laser beam printer of Embodiment III.

The laser beam printer comprises a main assembly 45 and a detachable imaging cartridge 41 as shown in FIG. 13. A case 45A of the main assembly 45 includes two windows having a lid 45B, and a catch tray 45C, respectively, on the upper surface thereof. The catch tray 45C is pivotal around a supporting point 45D, and is lifted upward to a position shown in a virtual line in FIG. 13. Likewise, the lid 45B is pivotal and lifted upward to a position shown in a virtual line. Such a construction makes it possible to remove the imaging cartridge 41 from the main assembly 45 by opening the catch tray 45 as well as to supply copy sheets by opening the lid 45B. Enclosed in the case 45A are a tray 451 at the bottom, a feeding roller 452, the imaging cartridge 41 held by supporting plates 455 and 456, a thermal fixing device 453 and an optical unit 403 above the supporting plates 455 and 456, respectively, a forwarding device 454, and a forwarding roller 457. The tray 451 is placed so that one end thereof is under the lid 45B and the other end is under the feeding roller 452. The forwarding device 454 is placed above the thermal fixing device 453, both of which consist of a pair of rollers. The forwarding roller 457 is placed above the forwarding device 454 so as to oppose to an opening of the main assembly 45. With slits 41B and 41C constituting a path for a copy sheet in the imaging cartridge 41 in addition to the above constituting, a copy sheet from the feeding roller 452 is forwarded to the fixing device 453 through the slits 41B and 41C, and further to the catch tray 45C through the forwarding device 454 and forwarding roller 457.

The imaging cartridge 41 comprises a photosensitive block 413 and a transferring block 416. The photosensitive block 413 encloses a photosensitive drum 401, an electrostatic charging brush 402, a developing device 404, and a blade 410 for scraping residual toner particles. In addition, a space 41A is formed in the photosensitive block 413, through which the optical unit 403 irradiates the laser beam to the photosensitive drum 401.

Whereas the transferring block 416 encloses a charging roller 417 which opposes to the photosensitive drum 401, and applies a given voltage to the copy sheet at a nip therebetween for the image transfer. The photosensitive drum 401 and charging roller 417 are designed so that they maintain the contact while the imaging cartridge 41 is set into the main assembly 45.

Figure 14:
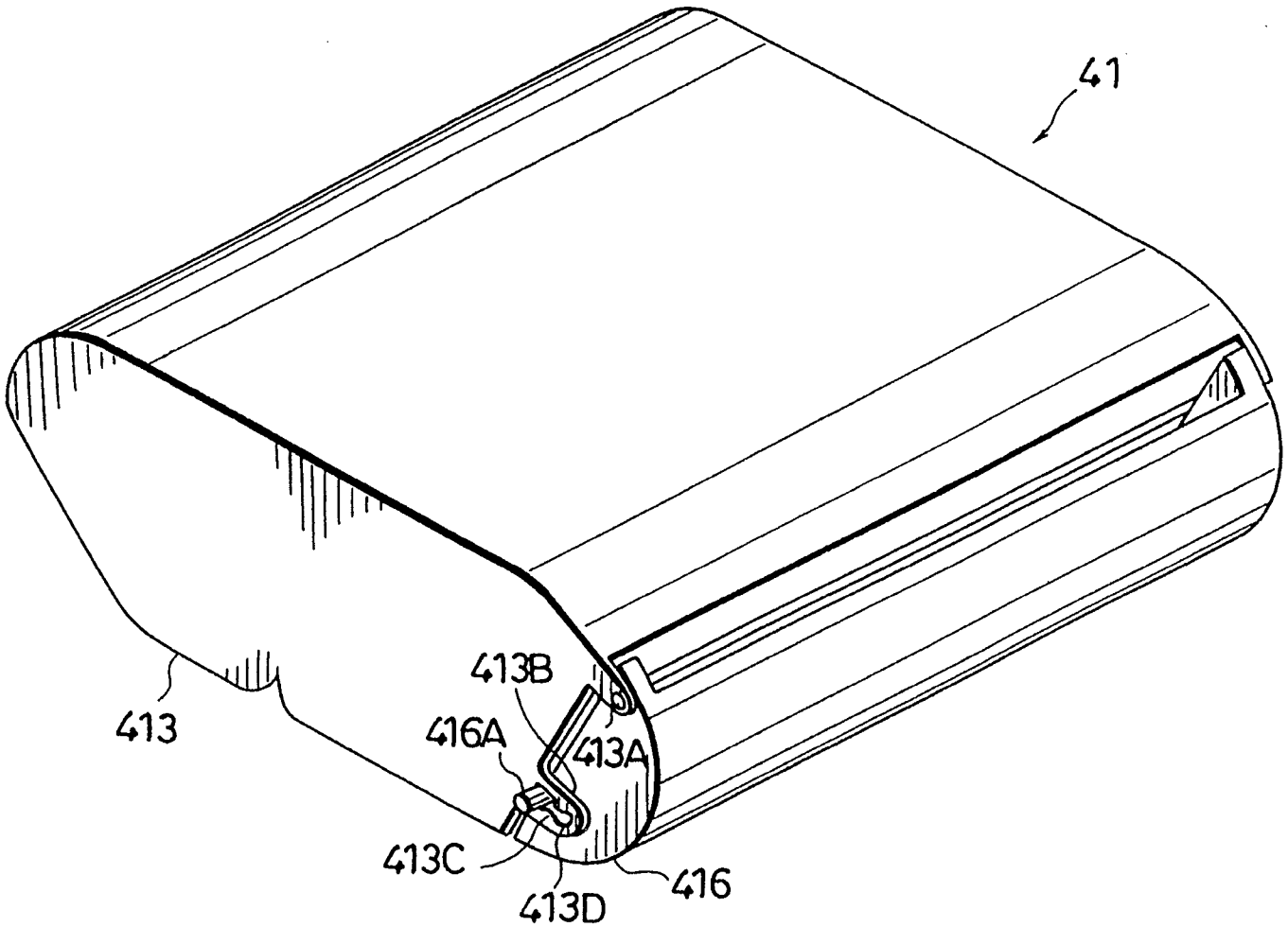
FIG. 14 is a perspective view of the imaging cartridge used for the laser beam printer.

As shown in FIG. 14, two protrusive axes 413A are formed at the upper portion of the side surfaces of the photosensitive block 413 close to the transferring block 416, respectively. The axes 413A fit into holes formed on the respective ends of the transferring block 416, enabling it to connect to the photosensitive block 413 pivotally around the axes 413A. In addition, two pins 416A, slidable within guiding holes 413D, penetrate through jaws 413B. Each guiding hole 413D has a detentes 413C, at which the width becomes slightly narrower than the diameter of the pins 416A, so that pins 416A are hooked thereat when the photosensitive block 413 is pulled, and if pulled harder, the pins 416A slide over the detentes 413C. Due to such a construction, the two blocks are connected with or released from each other as shown in FIGS. 15 and 16, respectively.

Figure 15:
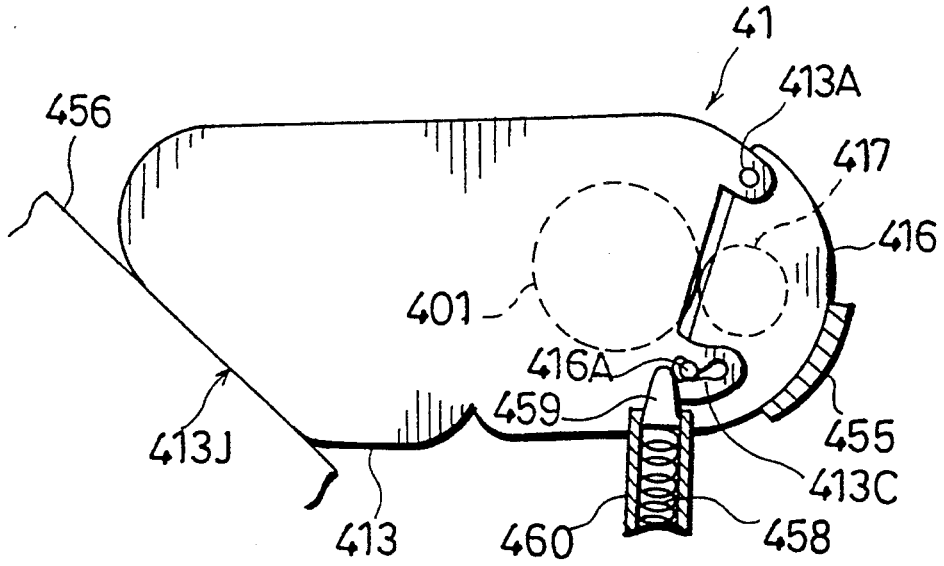
FIG. 15 is a side elevation of the imaging cartridge inserted in the laser beam printer.

In FIG. 15, the photosensitive block 413 and transferring block 416 are connected, in which a flat plane 413J formed at the bottom of the photosensitive block 413 contacts to the supporting plate 456, while the outer surface of the transferring block 416 contacts to the supporting plate 455.

Figure 16:
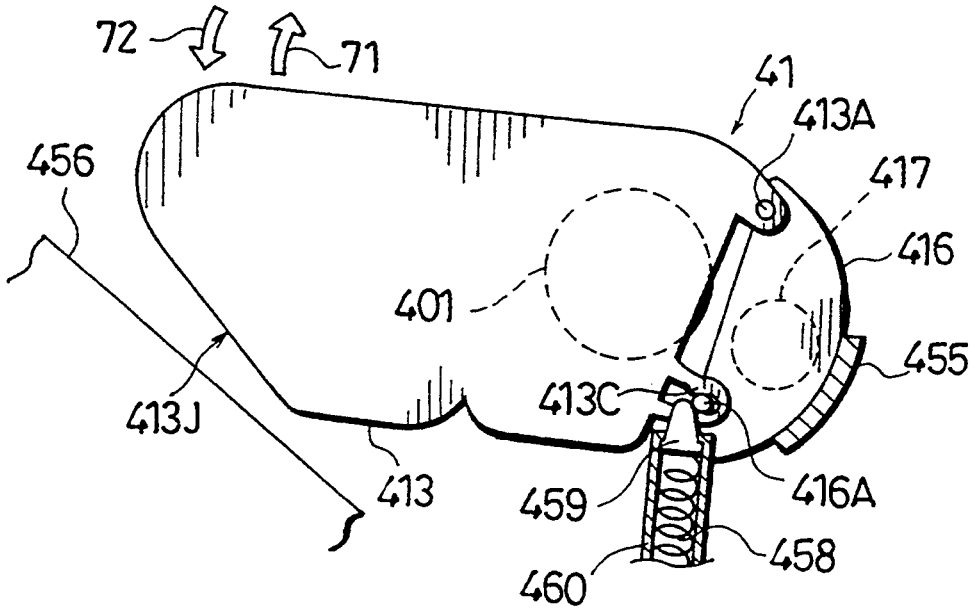
FIG. 16 is a side elevation of the imaging cartridge being removed from the laser beam printer.

In FIG. 16, the photosensitive block 413 and transferring block 416 are released, in which a stopper 459 with a round tip is placed in the vicinity of each pin 416A. Each stopper 459 is supported by a spring 458 inserted in a holding case 460, which is supported by the case 45A.

When the end of the photosensitive block 413 is lifted upward in the direction of an arrow 71, the stoppers 459 force the pins 416A to slide toward the detentes 413C. As a result, only the photosensitive block 413 is lifted upward, which motivates the transferring block 416 to rotate around the axes 413A. Further, the pins 416A slide over the detentes 413C to the end of the guiding holes 413D, so that the photosensitive block 413 is released from the transferring block 416, enabling easy jammed copy sheets clearance, and therefore, preventing damage to the photosensitive drum 401 due to the friction.

When the photosensitive block 413 is further lifted upward in the direction of the arrow 71, the pins 416A start to depress the stoppers 459 until they slide over the stoppers 459, making it possible to remove the transferring block 416 together with the photosensitive block 413 from the main assembly 45.

When the photosensitive block 413 is pressed down in the direction of an arrow 72, the stoppers 459 force the pins 416A to slide over to the end towards the supporting plate 456, hence, the photosensitive block 413 and transferring block 416 are connected. When the photosensitive block 413 is further pressed down, the stoppers 459 press down the pins 416A, and as a result, the transferring block 416 contacts to the supporting plate 455, while the flat plane 413J to the supporting plate 456, making it possible to set the imaging cartridge 41 at the predetermined position in the main assembly 45.

The release/connection of the two blocks may be linked with the opening of the catch tray 45C, or it may be proceeded with a button provided for such a purpose only.

Embodiment IV

Figure 17:
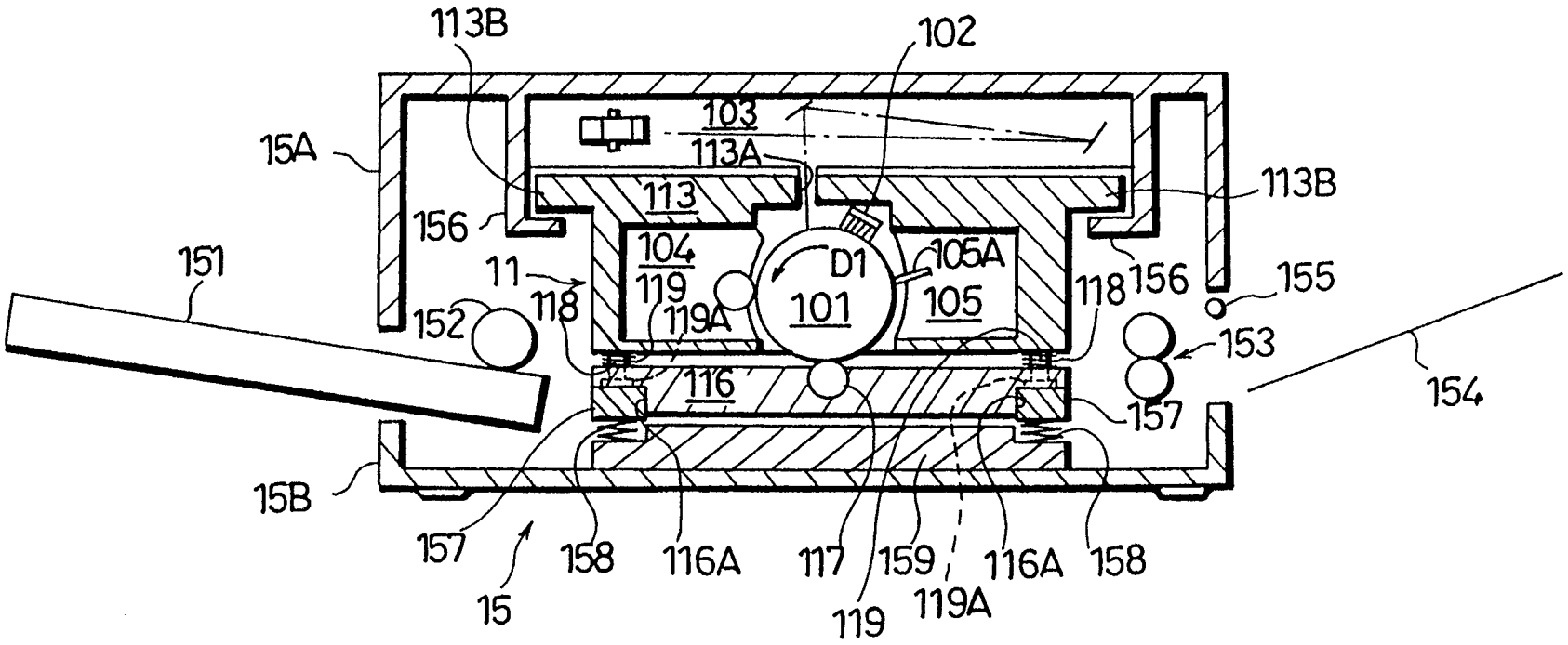
FIG. 17 is a cross sectional view of a laser beam printer of Embodiment IV.

Another laser beam printer comprising a main assembly 15 and a detachable imaging cartridge 11 is shown in FIG. 17.

The main assembly 15 comprises two cases 15A and 15B, the former is placed on top of the latter. The case 15A is hinged to the case 15B, enabling it to open pivotally around a hinge 155. At the opposing end to the hinge 155, a tray 151 and a feeding roller 152 are placed. At the end of the case 15B onto which the hinge 155 is mounted, a thermal fixing devise 153 consisting a pair of rollers, and a catch tray 154 are placed. An optical unit 103 is fixed to the internal of the case 15A, and a pair of L-shaped rails 156, opposing each other with the optical unit 103 therebetween, are formed inside the case 15A. The rails 156 fully extend in the direction perpendicular to FIGS. 17 and 18. The rails 156 fit into the protrusions 113B of the imaging cartridge 113B, making it possible to remove the imaging cartridge 11 from the main assembly 15 by sliding it along the rails 156.

The imaging cartridge 11 comprises a photosensitive block 113 and a transferring block 116. The former is placed on the latter through compressed springs 118, which urges the two blocks in reverse direction.

The photosensitive block 113 encloses a photosensitive drum 101, an electro-static charging brush 102, a developing device 104, and a cleaner 105 having a blade 105A for scraping residual toner particles. In addition, a slit 113A is formed on the upper surface of the photosensitive block 113, through which the optical unit 103 irradiates the leaser beam to the photosensitive drum 101. Whereas the transferring block 116 includes a charging roller 117 for the image transfer.

The photosensitive drum 101 turns counterclockwise as indicated an arrow D1. After the electro-static charging brush 102 charges a given voltage to the photosensitive drum 101, the optical unit 103 irradiates the laser beam thereto in order to form an electro-static latent image, which is developed into a toner image with toner supply. In the meantime, a copy sheet in the tray 151 is forwarded to a nip between the photosensitive drum 101 and charging roller 117 through the feeding roller 152, so that the toner image on the photosensitive drum 101 is transferred onto the copy sheet at the nip. Further the fixing device 153 fixes the toner image onto the copy sheet and forwards it to the catch tray 154, while the blade 105A scrapes the residual toner particles, which are collected to a space in the cleaner 105.

Figure 19:
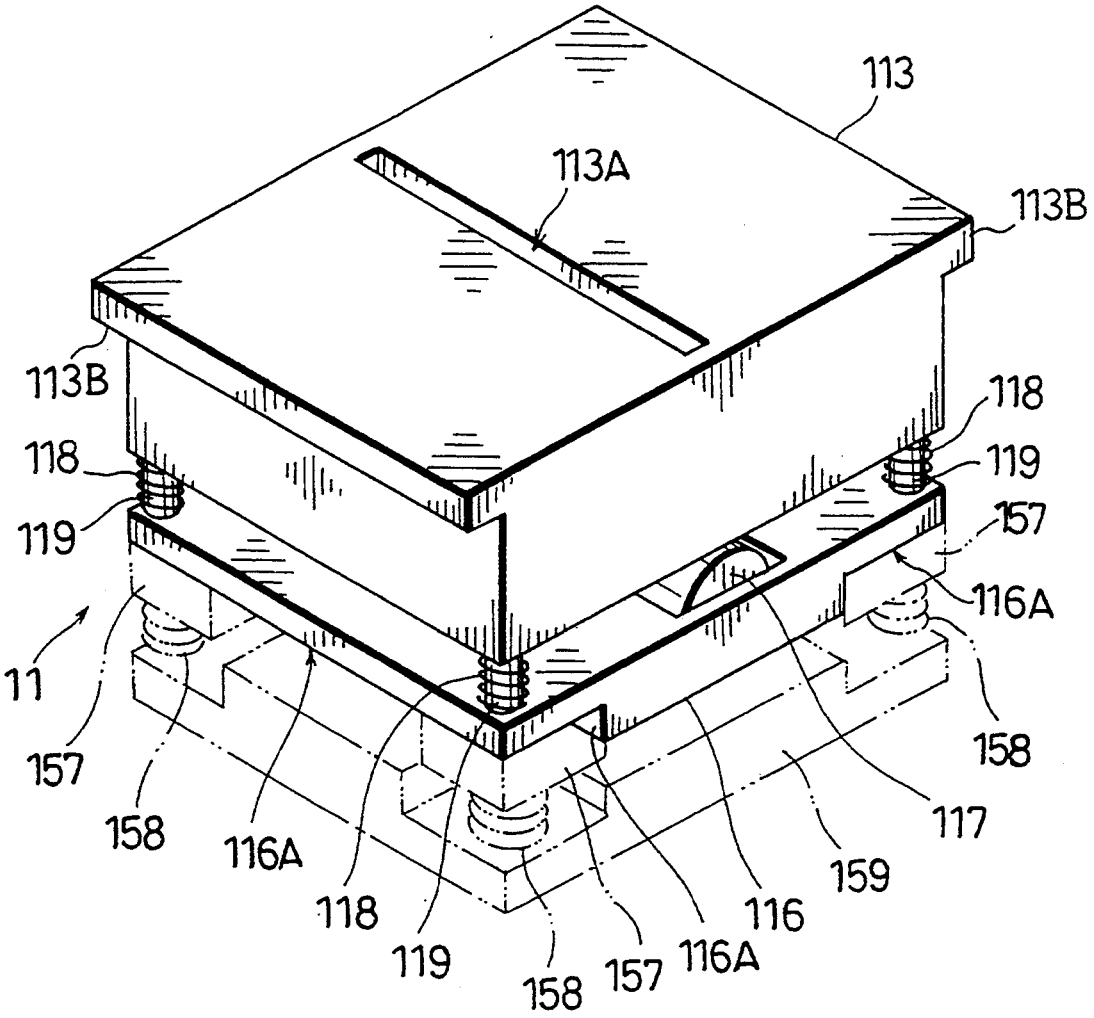
FIG. 19 is a perspective view of the imaging cartridge for the laser beam printer.

As shown in FIG. 19, a platform 159 is adhered to the internal base of the case 15B, and through a compressed spring 158, a placenta 157 is provided at each corner thereof. Thus, the imaging cartridge 11 placed upon the placentae 157 is urged upward by the compressed springs 158. Because the transferring block 116 has a convex form with notches 116A extended to a longitudinal direction at the bottom, when the case 15A is closed with enclosing the imaging cartridge 11 therein, the notches 116A contact to the placentae 157, placing the transferring block 116 thereon. As a result, the compressed springs 158 urge the transferring block 116 upward through the placentae 157. However, since the urge of the springs 158 is larger than that of the springs 118, it forces the photosensitive block 113 and transferring block 116 to move closer, enabling the photosensitive drum 101 and charging roller 107 to contact each other.

Figure 18:
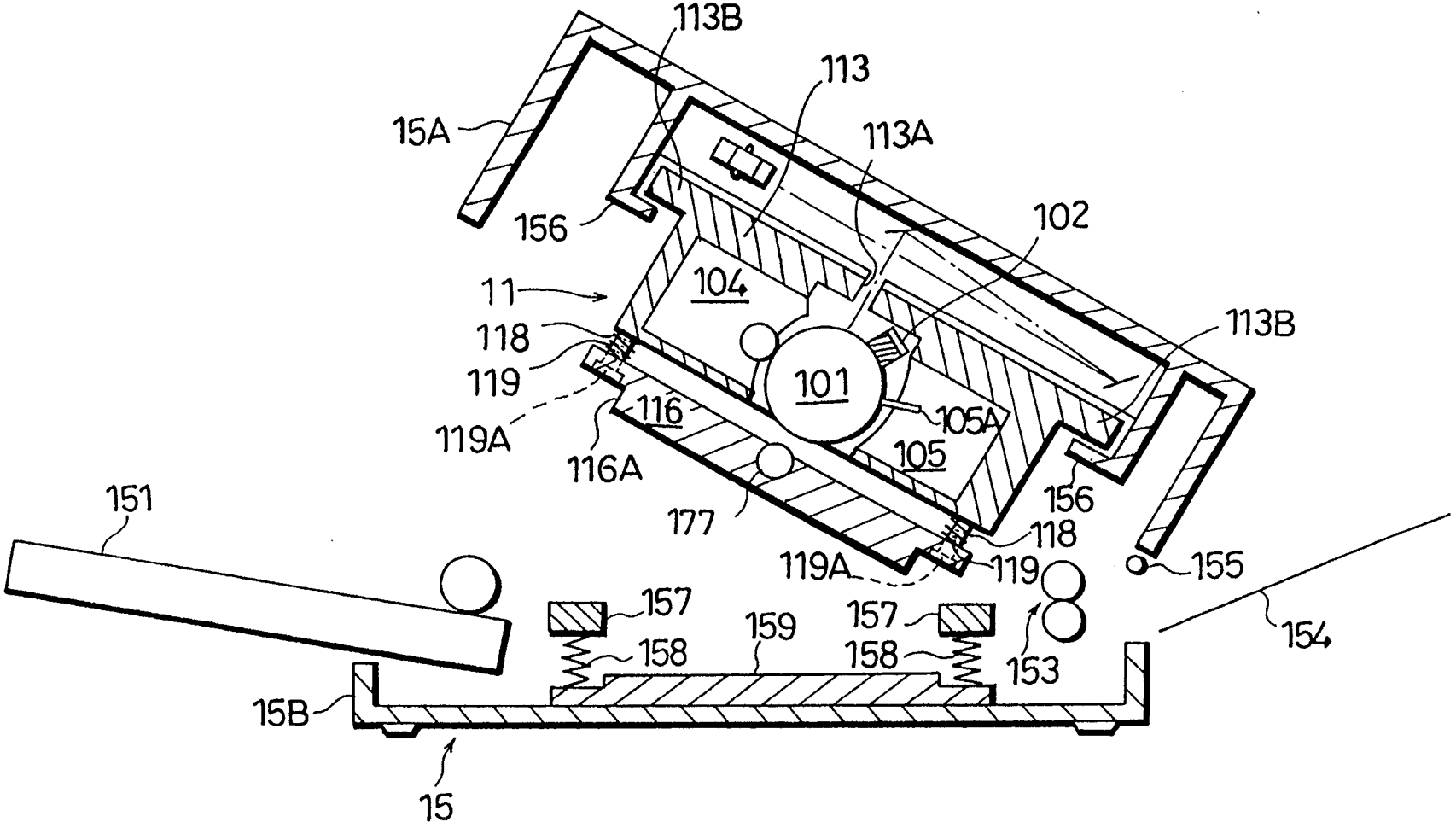
FIG. 18 is a cross sectional view of the laser beam printer with its cap open.

When the case 15A is lifted upward as shown in FIG. 18, the imaging cartridge 11 is lifted from the placentae 157, due to the fitting of protrusions 113B into the rails 156. Since the transferring block 116 is released from the compressed springs 158, it loses the contact with the photosensitive block 113 because of the urge of the compressed springs 118 or the self weight, which results in releasing the photosensitive drum 101 from the charging roller 107 with a give space. More precisely, the compressed springs 118 between the two blocks are adhered to respective corner in the base of the photosensitive block 113 at the upper end of pins 119 in the compressed springs 118. Each pin 119 fits into a hole formed at the opposing corner on the transferring block 116, and it has a bottom end 119A, of which diameter is slightly larger that of the tube in order to prevent the transferring block 116 from coming out of the holes. Thus, unless some force is applied to the transferring block 116, it maintains the contact to the bottom ends 119A, making it possible to maintain a given space between the photosensitive drum 101 and charging roller 117, while connecting the photosensitive block 113 and transferring block 113.

Such a construction makes it possible to release the jammed copy sheet between the photosensitive drum 101 and charging roller 107 at the removal of the imaging cartridge 11 as well as to prevent damage to the photosensitive drum 101.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a main assembly; and an imaging cartridge detachable from the main assembly and including a first unit and a second unit both being separable from each other, a toner image carrier provided in the first unit, and a charging roller provided in the second unit for transferring a toner image on the toner image carrier onto a copy sheet conveyed without being wound around the charging roller.

2. An image forming apparatus of claim 1, wherein a path for a copy sheet is formed between the first unit and the second unit.

3. An image forming apparatus of claim 1, the image forming apparatus further comprising:

operating means installed in the main assembly for separating the second unit from the first unit.

4. An image forming apparatus of claim 3, the image forming apparatus further comprising:

copy sheet detecting means for detecting the presence of a copy sheet in the imaging cartridge, and wherein the operating means is operated in accordance with a detecting result of the copy sheet detecting means.

5. An image forming apparatus of claim 3, the image forming apparatus further comprising:

jamming detection means for detecting occurrence of a jamming of a copy sheet, and wherein the operating means is operated in accordance with detecting result of the jamming detection means.

6. An image forming apparatus of claim 3, the image forming apparatus further comprising;

life end detecting means for detecting life end of the imaging cartridge, and wherein the operating means is operated in accordance with a detecting result of the life end detecting means.

7. An image forming apparatus of claim 1, wherein the imaging cartridge further includes cleaning means for removing residual toner particles on the charging roller.

8. An image forming apparatus of claim 1, wherein the imaging cartridge further includes erasing means for removing a charge on a copy sheet, the erasing means being located downstream of the copy sheet flow with respect to the charging roller.

9. An image forming apparatus of claim 1, wherein the first unit and the second unit are separated from each other when the imaging cartridge is removed from the main assembly.

10. An imaging cartridge detachable from the main assembly of an image forming apparatus comprising:

a first unit and a second unit, the second unit being separable from the first unit;

a toner image carrier provided in the first unit; and a charging roller provided in the second unit for transferring a toner image on the toner image carrier onto a copy sheet conveyed without being wound around the charging roller.

11. An imaging cartridge of claim 10, wherein a path for a copy sheet is formed between the first unit and the second unit.

12. An imaging cartridge of claim 10, the imaging cartridge further comprising:

cleaning means installed in the second unit for removing residual toner particles on the charging roller.

13. An imaging cartridge of claim 10, the imaging cartridge further comprising:

a cleaning blade installed so that it contacts the charging roller for removing residual toner particles on the charging roller.

14. An imaging cartridge of claim 10, the imaging cartridge further comprising:

erasing means for removing a charge on a copy sheet, the erasing means being located downstream of a copy sheet flow with respect to the charging roller.

15. An image forming apparatus comprising:

a main assembly; and an imaging cartridge detachable from the main assembly including a first unit and a second unit both being separable from each other, a toner image carrier provided in the first unit, a charging roller provided in the second unit for transferring a toner image on the toner image carrier onto a copy sheet, connecting means for connecting the first unit and the second unit, and releasing means for releasing connection of the first unit and the second unit by the connecting means.

16. An image forming apparatus of claim 15, wherein the connecting means is pivotable and is installed in the first unit, and includes a lever, one end of which engages with the second unit.

17. An image forming apparatus of claim 15, the image forming apparatus further comprising:

operating means installed in the main assembly for operating the releasing means of the imaging cartridge.

18. An image forming apparatus of claim 17, the image forming apparatus further comprising:

copy sheet detecting means for detecting the presence of a copy sheet in the imaging cartridge, and wherein the operating means is operated in accordance with a detecting result of the copy sheet detecting means.

19. An image forming apparatus of claim 17, the image forming apparatus further comprising:

jamming detecting means for detecting occurrence of a jamming of a copy sheet, and wherein the operating means is operated in accordance with a detecting result of the jamming detection means.

20. An image forming apparatus of claim 17, the image forming apparatus further comprising:

life end detecting means for detecting life end of the imaging cartridge, and wherein the operating means is operated in accordance with a detecting result of the life end detecting means.

21. An image forming apparatus of claim 15, wherein the imaging cartridge includes cleaning means for removing residual toner particles on the charging roller.

22. An image forming apparatus of claim 15, wherein the imaging cartridge includes erasing means for removing a charge on a copy sheet, the erasing means being located downstream of the copy sheet flow with respect to the charging roller.

23. An imaging cartridge detachable from a main assembly of an image forming apparatus comprising:

a first unit and a second unit both being separable from each other;

a toner image carrier provided in the first unit;

a charging roller provided in the second unit for transferring a toner image on the toner image carrier onto a copy sheet;

connecting means for connecting the first unit and the second unit; and releasing means for releasing connection of the first unit and the second unit by the connecting means.

24. An imaging cartridge of claim 23, wherein a path for a copy sheet is formed between the first unit and the second unit.

25. An imaging cartridge of claim 23, the imaging cartridge further comprising:

a cleaning blade installed so that it contacts said charging roller for removing residual toner particles on the charging roller.

26. An imaging cartridge of claim 23, the imaging cartridge further comprising:

erasing means for removing a charge on a copy sheet, the erasing means being located downstream of the copy sheet path with respect to the charging device roller.

27. An imaging cartridge of claim 23, wherein the connecting means is pivotable and is installed in the first unit, and includes a lever, one end of which engages with the second unit.

28. An image forming apparatus comprising:

a main assembly dividable into an upper unit and a lower unit; and a first unit and a second unit both being releasable from each other, a toner image carrier provided in the first unit, a charging roller provided in the second unit for transferring a toner image on the toner image carrier onto a copy sheet, and releasing means for releasing the first unit and the second unit in relation with separation of the upper unit and the lower unit.

29. An image forming apparatus comprising:

a main assembly; and an imaging cartridge detachable from the main assembly including a first unit and a second unit both being releasable from each other, a toner image carrier provided in the first unit, a charging roller provided in the second unit for transferring a toner image on the toner image carrier onto a copy sheet, and releasing means for releasing the first unit and the second unit in relation with an operation of removing the imaging cartridge from the main assembly.

30. An imaging cartridge detachable from a main assembly of an image forming apparatus, said detachable imaging cartridge comprising:

a housing;

a toner image carrier provided in the housing;

a charging roller provided in the housing for transferring a toner image on the toner image carrier onto a copy sheet; and cleaning means provided in the housing for removing residual toner particles on the charging roller.

31. An imaging cartridge of claim 30, wherein the housing includes a releasable first unit and a releasable second unit, the toner image carrier is installed in the first unit, and the charging roller and the cleaning means are installed in the second unit.

32. An imaging cartridge of claim 31, wherein a sealing member is formed in a space between the second unit of the housing and the charging roller so as to seal the space therebetween.

33. An imaging cartridge of claim 30, wherein the cleaning means includes a cleaning blade contacting the charging roller.

34. An imaging cartridge of claim 30, the imaging cartridge further comprising:

a used toner tank installed in the housing for storing residual toner particles removed by the cleaning means.

35. An imaging cartridge detachable from a main assembly of an image forming apparatus comprising:

a housing, a toner image carrier provided in the housing;

copy sheet guiding means installed in the housing for guiding a copy sheet passing through the housing;

erasing means installed at a position where it opposes a copy sheet upon having a toner image transferred thereon from the toner image carrier for removing a charge on the copy sheet; and a charging device provided in the housing for transferring a toner image on the toner image carrier onto a copy sheet, wherein the housing includes a releasable first unit and a releasable second unit, the toner image carrier is provided in the first unit, and the charging device, the copy sheet guiding means, and the erasing means are provided in the second unit, wherein the charging device includes a charging roller.

36. An imaging cartridge of claim 35, wherein the erasing means includes tapering conductive members which oppose a copy sheet.

37. An image forming apparatus comprising:

a main assembly; and an imaging cartridge detachable from the main assembly including a first unit, a second unit separate from the first unit, a toner image carrier provided in the first unit, a charging roller provided in the second unit for transferring a toner image on the toner image carrier onto a copy sheet, and a lock member for locking the first unit and the second unit together.

38. An image cartridge detachable from a main assembly of an image forming apparatus comprising:

a first unit and a second unit both being separate from each other;

a toner image carrier provided in the first unit;

a charging roller provided in the second unit for transferring a toner image on the toner image carrier onto a copy sheet; and a lock member for locking the first unit and the second unit together.

39. An image forming apparatus comprising:

a main assembly; and an imaging cartridge detachable from the main assembly including a first unit, a second unit, a toner image carrier provided in the first unit, a charging roller provided in the second unit for transferring a toner image on the toner image carrier onto a copy sheet, and connecting means for connecting the first unit to the second unit as the charging roller is movable away from the toner image carrier.

40. An imaging cartridge detachable from a main assembly of an image forming apparatus comprising:

a first unit;

a second unit;

a toner image carrier provided in the first unit;

a charging roller provided in the second unit for transferring a toner image on the toner image carrier onto a copy sheet; and connecting means for connecting the first unit to the second unit as the charging roller is movable away from the toner image carrier.

41. An image forming apparatus comprising:

a main assembly; and an imaging cartridge detachable from the main assembly including a first unit and a second unit both being separable from each other, a toner image carrier provided in the first unit, a charging roller provided in the second unit for transferring a toner image on the toner image carrier onto a copy sheet, and a guiding member arranged on said first unit or on said second unit for guiding the copy sheet.

42. An image forming apparatus comprising:

a main assembly; and an imaging cartridge detachable from the main assembly including a first unit, a second unit positioned by a horizontal side of the first unit and being separable from the first unit, a toner image carrier provided in the first unit, and a charging roller provided in the second unit for transferring a toner image on the toner image carrier onto a copy sheet, wherein the copy sheet is conveyed vertically upward between said toner image carrier and said charging roller.

* * * * *

UNITED STATES PATENT AND TRADEMARK OFFICE

CERTIFICATE OF CORRECTION

PATENT NO. : 5,371,575

DATED : December 6, 1994

INVENTOR(S) : Hitoshi Sekino, et al.

It is certified that error appears in the above-identified patent and that said Letters Patent is hereby corrected as shown below:

On the Cover Page, line 5 of the Abstract paragraph, change "form" to --from--.

In col. 5, line 1, change "$\beta$" to --$\delta$--.

In col. 8, line 32, change "leaser" to --laser--.

In col. 9, line 23, change "transferring block 113" to --transferring block 116--.

In col. 9, line 67 (Claim 5, line 5), after "with" insert --a--.

In col. 12, line 46 (Claim 35, line 3), change "," to --;--.

In col. 12, line 61 (Claim 35, line 18), after "unit," insert --and--.

Signed and Sealed this

Third Day of October, 1995

*Attest:*

Bruce Lehman

BRUCE LEHMAN

*Attesting Officer*

*Commissioner of Patents and Trademarks*